US006883209B2

(12) United States Patent
Andersen

(10) Patent No.: US 6,883,209 B2
(45) Date of Patent: Apr. 26, 2005

(54) PLANT FOR REMOVING FINES FROM FIBER FLUFF

(75) Inventor: Jens Ole Bröchner Andersen, Skanderborg (DK)

(73) Assignee: M & J Fibretech A/S, Horsens (DK)

( * ) Notice: Subject to any disclaimer, the term of this patent is extended or adjusted under 35 U.S.C. 154(b) by 142 days.

(21) Appl. No.: 10/463,505

(22) Filed: Jun. 16, 2003

(65) Prior Publication Data

US 2003/0217439 A1 Nov. 27, 2003

Related U.S. Application Data

(63) Continuation of application No. PCT/DK00/00711, filed on Dec. 19, 2000.

(51) Int. Cl.[7] ..... D04H 11/00
(52) U.S. Cl. ..... 19/161.1; 19/305
(58) Field of Search ..... 19/65 A, 65 R, 19/148, 161.1, 200, 204, 205, 301–305, 308; 162/4; 264/70, 210.8, 518; 425/82.1

(56) References Cited

U.S. PATENT DOCUMENTS 3,748,693 A * 7/1973 Jespersen ..... 425/82.1
3,915,202 A * 10/1975 Curtis et al. ..... 139/425 A
4,258,455 A * 3/1981 Werner ..... 19/303
4,332,756 A * 6/1982 Bean et al. ..... 264/70
4,366,111 A * 12/1982 Dinius et al. ..... 264/518
4,375,448 A * 3/1983 Appel et al. ..... 264/518
4,400,148 A 8/1983 Lawrence et al. ..... 425/155
4,615,767 A * 10/1986 Miers et al. ..... 162/4
5,766,531 A * 6/1998 Cadieux et al. ..... 264/210.8

FOREIGN PATENT DOCUMENTS

GB 2 031 970 A 4/1980

* cited by examiner

*Primary Examiner*—Gary L. Welch
(74) *Attorney, Agent, or Firm*—Winston & Strawn LLP

(57) ABSTRACT

A plant for removing fines from fiber fluff. The plant includes a forming wire, a forming head which is placed above the forming wire and arranged for air-laying fiber fluff into a layer upon the forming wire, at least one channel for carrying, in a flow of air, fibers from a supply of fibers into the forming head, a suction box placed beneath the forming wire, at least one vacuum fan connected to the suction box for generating an air flow from the forming head, through the fluff, the forming wire, and the suction box to the at least one vacuum fan. The mesh count of the forming wire mainly allow only the fines contained in the fluff to pass through the forming wire. The troublesome and costly filtering of the water used in a hydroentangling process is advantageously eliminated when using fluff, which is freed from fines by means of the plant according to the invention. Air-laid webs produced of the fine-free fibers also have a high quality.

4 Claims, 1 Drawing Sheet

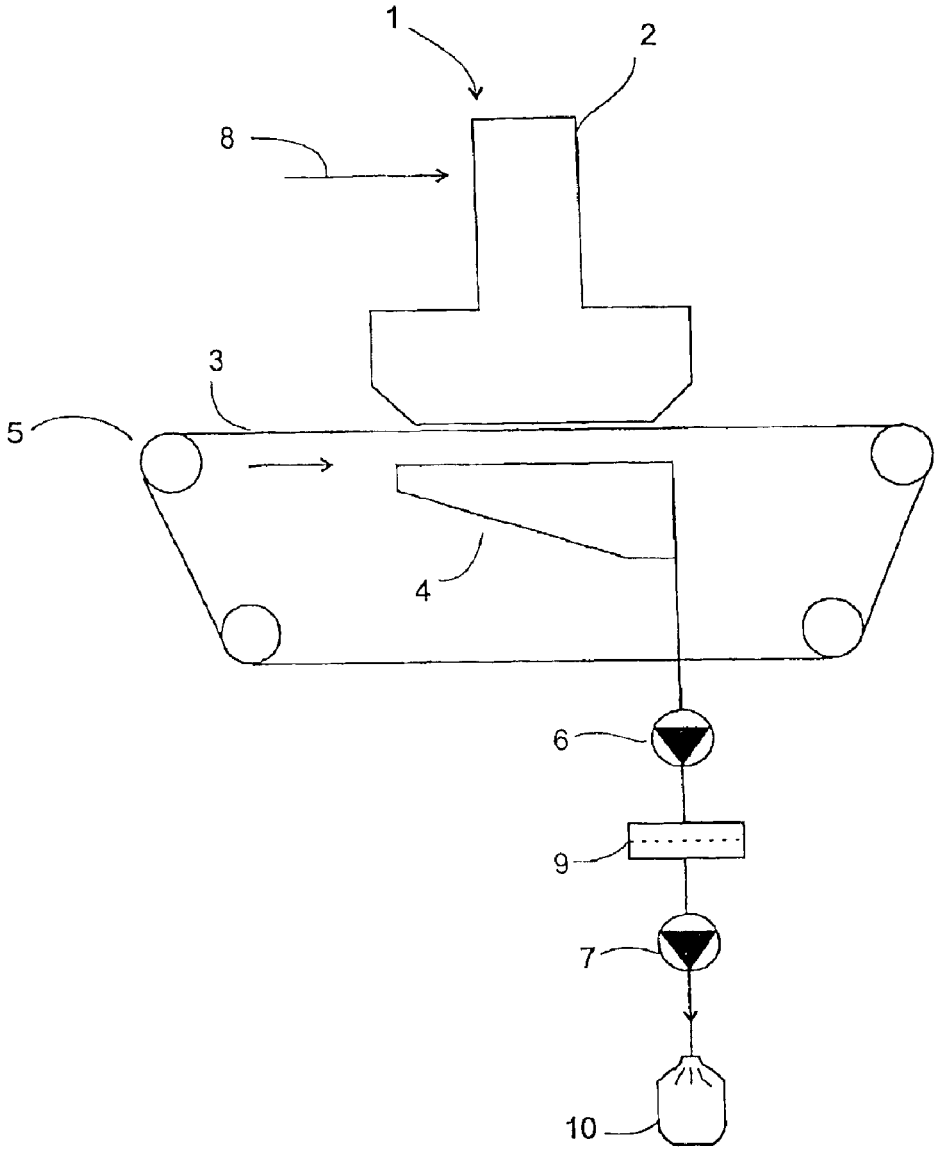
1
2
8
3
5
4
6
9
7
10

PLANT FOR REMOVING FINES FROM FIBER FLUFF

CROSS-REFERENCE TO RELATED APPLICATION

This application is a continuation of International Application PCT/DK00/00711 filed Dec. 19, 2000, the entire content of whichis expressly incorporated herein by reference thereto.

BACKGROUND ART

The invention relates to a plant for removing fines from fiber fluff comprising a forming wire, a forming head which is placed above the forming wire and arranged for air-laying fiber fluff into a layer upon the forming wire, at least one channel for carrying, in a flow of air, fibers from a supply of fibers into the forming head, a suction box placed at the lower side of the forming wire, at least one vacuum fan connected to the suction box for generating an air flow from the forming head, through the fluff, the forming wire, and the suction box to the at least one vacuum fan.

Fluff of e.g. cellulose fibers and/or synthetic fibers is generally used for producing air-laid webs in plants where the fluff is air-laid in layers upon at least one wire, and the air-laid layers subsequently run through a number of further production steps for obtaining a wanted structure and quality of the web.

Such webs are among other things used for the manufacturing of disposable non-woven products of which can be mentioned, absorbent core material for feminine hygiene articles, incontinence articles, diapers, table top napkins, hospital products such as bed protection sheets, wipes, and towels.

The webs used for such products usually have a weight of about 20–80 g/m$^2$.

Heavy-duty webs having weights of about 80–2000 g/m$^2$ can advantageously be used for producing e.g. corrugated board and heat—and/or sound insulating materials.

The fiber fluff normally contains fines which are small fiber particles in order of 10 to 50$\mu$. These fines tend to reduce the quality of the air-laid web and with that also the products which are manufactured of the web.

The above named further production steps of the fluff frequently also include a hydroentangling process where jets of water are, under influence of a pressure of e.g. 100 bar, directed through fine nozzles towards the fluff, thereby entangling the fluff into a coherent web.

The water used for hydroentangling the fluff is normally recirculated back to the nozzles for being reused whereby fines in the fluff will be dispersed in the water penetrating the fluff.

The dispersed fines in the reused water tend to get stuck in the fine nozzles which then stop to function thereby causing a costly stop-down for the total plant.

In the recirculation cycle is therefore inserted a filter for removing fines from the water.

Filtering particles as small as fines require, however, a complex filter having a number of filtering steps. The filter in itself and the servicing of the filter are therefore very costly.

The disadvantages of the prior art are now resolved by the present invention.

SUMMARY OF THE INVENTION

The present invention now provides a plant for effectively separating in a simple fines from paper fluff.

The novel and unique features according to the invention whereby this is achieved is the fact that the mesh count of the forming wire is chosen such that mainly only fines contained in the fluff are allowed to pass the forming wire.

Thereby it is possible to obtain fine-free products of high quality. When the webs, during the production process, are hydroentangled, this process can also be carried out without the conventional troublesome and costly filtering of the water used to hydroentangle the web.

The mesh count of the forming wire can according to the invention more specifically be between 14 and 30 mesh while the differential pressure between the forming head and the suction box can be between 80 to 150 mm water head.

BRIEF DESCRIPTION OF THE DRAWING

The invention will be explained in greater details below where further advantageous properties and an exemplary embodiment are described with reference to the sole drawing FIGURE which illustrates in a diagrammatic view a forming station that removes fines from fluff in accordance with the invention.

DETAILED DESCRIPTION OF THE PREFERRED EMBODIMENTS

FIG. 1 shows a forming station 1 which mainly consists of a forming head 2 placed above a forming wire 3 and a suction box 4 placed below the forming wire. The forming wire runs, during operation, around four rolls 5 in the direction indicated by the arrow. A differential pressure is generated over the forming wire by means of first and second vacuum fans 6, 7 which are connected to the suction box 4.

Fibers from a supply of fibers (not shown) are via a channel 8 carried into the forming head in a flow of air. The fibers are by means of the differential pressure deposited in a layer of fluff onto the forming wire.

The fluff normally contains fines, which are small fiber particles on the order of 10 to 50$\mu$. For removing the fines from the fluff the mesh count of the forming wire and the differential pressure between the forming head and the suction box are chosen such that mainly only fines contained in the fluff are allowed to pass the forming wire.

The mesh count of the forming wire is, more specifically, about 14 to 30 mesh while the mesh count of a conventional forming wire normally is about 31 to 38 mesh.

The coarser forming wire according to the invention results in a reduction of the differential pressure from the conventional value of about 180 to 270 mm water head to about 80 to 150 mm water head.

The fluff on the forming wire is thereby deposited in a light and airy layer which is easily blown through by the flow of air with velocities so low that the fines but not the fibers are conveyed by the air which is flowing through the fluff and the forming wire.

A filter 9 is arranged between the first and second vacuum fans 6, 7 for removing fines from the flow of air. The removed fines are collected in a sack 10 or a similar device.

The fine-free fibers can be collected in containers or sacks (not shown) for afterwards being used in e.g. a plant for producing air-laid webs.

The plant according to the invention also can constitute the forming station of such a plant whereby the fine-free fluff on the forming wire 3 directly is transferred to the subsequent production stations.

When the production steps in a plant for producing air-laid webs include a hydroentangling process, the former troublesome and costly filtering of the water used in the process is advantageously eliminated.

Air-laid webs produced of the fine-free fibers also have a high quality, which often is wanted for e.g. disposable non-woven products.

What is claimed is:

1. A plant for removing fines from fiber fluff comprising:

a forming wire having a mesh count of between 14 and 30 mesh, a forming head placed above the forming wire and arranged for air-laying of fiber fluff into a layer upon the forming wire, at least one channel for carrying, in a flow of air, fibers from a supply of fibers to the forming head, a suction box placed beneath the forming wire, and at least one vacuum fan connected to the suction box for generating an air flow from the forming head, through the fiber fluff, the forming wire, and the suction box to the at least one vacuum fan, wherein the air flow generated by the at least one vacuum provides a differential pressure between the forming head and the suction box, the differential pressure being between about 80 and 150 mm water head.

2. The plant according to claim 1 wherein first and second vacuum fans are provided, and further comprising a filter connected to the first vacuum fan for removing fines from the air supplied to the filter by the first vacuum fan, and the second vacuum fan is connected to the filter for removing the filtered air from the filter.

3. The plant according to claim 2, further comprising a collector device for collecting fines from the filter.

4. The plant according to claim 1, further comprising a collector device for collecting fines removed from the fiber fluff.

* * * * *